US005716244A

United States Patent [19]

Egenolf et al.

[11] Patent Number: 5,716,244

[45] Date of Patent: Feb. 10, 1998

[54] PART OF AN ELECTRICAL CONTACT AND ELECTRICAL CONTACT

[75] Inventors: Bernhard Egenolf, Dreieich; Johann Kilzer, Egelsbach; Mile Trajkov, Frankfurt, all of Germany

[73] Assignee: The Whitaker Corporation, Wilmington, Del.

[21] Appl. No.: 709,459

[22] Filed: Sep. 5, 1996

[30] Foreign Application Priority Data

Sep. 21, 1995 [DE] Germany ..... 195 35 148.7

[51] Int. Cl.[6] ..... H01R 13/87

[52] U.S. Cl. ..... 439/843

[58] Field of Search ..... 439/843, 842, 439/839, 844, 845, 846, 847, 849, 850, 851, 852, 854, 856, 857, 858, 861, 862, 828

[56] References Cited

U.S. PATENT DOCUMENTS

| | | | |
|---|---|---|---|
| 4,047,791 | 9/1977 | Carter | 439/828 |
| 4,919,628 | 4/1990 | Mobley et al. | 439/852 |
| 4,932,906 | 6/1990 | Kaley et al. | 439/857 |
| 5,295,873 | 3/1994 | Walbrecht | 439/839 |
| 5,599,212 | 2/1997 | Sawada | 439/852 |

FOREIGN PATENT DOCUMENTS

| | | | |
|---|---|---|---|
| 0 517 139 A2 | 12/1992 | European Pat. Off. . | |
| 000568927A1 | 11/1993 | European Pat. Off. | 439/843 |
| 88 13 575 U | 1/1989 | Germany | H01R 13/18 |
| 4015230 | 11/1990 | Germany | 439/839 |
| 92 01 047 U | 6/1993 | Germany | H01R 13/18 |
| 195 35 148.7 | 12/1995 | Germany | H01R 13/18 |

*Primary Examiner*—Cary F. Paumen
*Assistant Examiner*—Tho Dac Ta

[57] ABSTRACT

A part of an electric contact is specified, which is formed from a sheet, is constructed in the shape of a box, has at least four side walls and is assembled in such a way that there is located in one side wall a seam a which opposite edges of the sheet abut one another. The opposite edges are of counter-balanced configuration, and two projections are provided on the edge, and two recesses on the edge. A depression in the shape of half a spherical cap is located on the edge between the recesses. Depressions in the shape of half a spherical cap are arranged on the edge in the projections. The arrangement is intended to prevent the two edges from overlapping by virtue of a lateral effect of force.

9 Claims, 2 Drawing Sheets

PART OF AN ELECTRICAL CONTACT AND ELECTRICAL CONTACT

BACKGROUND OF THE INVENTION

1. Field of the Invention

The invention relates to a part of an electrical contact and to an electric contact having an inner contact member and an outer spring member.

2. Description of the Prior Art

EP 517 139 discloses an electric contact which serves to produce a plug-and-socket connection and has a pair of contact spring arms. Furthermore, the plug connector has an outer spring member which has a pair of outer spring arms. The outer spring member is formed from a sheet and constructed in the shape of a box, has at least four side walls and is assembled in such a way that there is located in one side wall a seam at which opposite edges of the sheet abut one another. The outer spring member is closed by welding at this seam location. It is preferred to use a laser spot-welding process. The outer spring member serves to protect the inner contact spring arms.

A problem in the present electric contact is that upon bending of the outer spring member the two edges may overlap instead of abutting one another. It is also possible for such an overlap to be produced during transport by an appropriate pressure effect.

SUMMARY OF THE INVENTION

It is an object of the invention to specify a part of an electric contact for a plug-and-socket connection which is configured such that the opposite edges of the sheet abut one another with their edges at the seam location.

The object is achieved by a part of an electric contact being formed from a sheet, being constructed in the shape of a box, having at least four side walls and being assembled in such a way that a seam is located in one side wall at which opposite edges of the sheet abut one another, the opposite edges being at least partially of counterbalanced configuration and at least one edge having a projection and the other edge having a corresponding recess, and the opposite edges having at least one embossed elevation or depression.

The object is further achieved by an electric contact for a plug-and-socket connection comprising an inner contact member and an outer spring member which is formed from a sheet, the outer spring member being constructed in the shape of a box, having at least four side walls and being assembled in such a way that there is located in one side wall a seam at which opposite edges of the sheet abut one another, the opposite edges being at least partially of counterbalanced configuration and at least one edge having a projection and the other edge having a corresponding recess, and in that the opposite edges in each case have at least one embossed elevation or at least one embossed depression.

Many electric contacts have parts which are constructed in the shape of a box. Such a part is specified which is formed from a sheet, is constructed in the shape of a box, has at least four side walls and is assembled in such a way that there is located in one side wall a seam at which opposite edges of the sheet abut one another. The part is distinguished in that the opposite edges are at least partially of counterbalanced configuration and at least one edge has a projection and the other edge has a corresponding recess. However, by way of example the edges can also be configured in a meandering or corrugated fashion. Moreover, the part is distinguished in that the opposite edges in each case have at least one embossed elevation or in each case at least one embossed depression. The opposite edges can also have both a depression and an elevation.

The result of this configuration of the part in the shape of a box is that the opposite edges cannot overlap one another. An overlap would lead to a very large spacing of the opposite edges. Furthermore, the elevations and depressions prevent the opposite edges from pushing over one another in the case of a lateral pressure. The configuration of the opposite edges in such a way that they are counterbalanced with projections and corresponding recesses and are not simply straight has the effect of preventing mutual shearing of the edges.

It is particularly advantageous when the bosses are configured as depressions, that is to say when they extend in the direction of the interior of the box. In this case, these depressions can simultaneously serve, for example, as guides for further parts inserted into the part in the shape of a box. In order to achieve particularly effective fixing of the edges on one another, the latter can additionally be welded to one another. It is particularly advantageous to weld the edges in a pointwise fashion using a laser.

DETAILED DESCRIPTION OF THE PREFERRED EMBODIMENT

Figure 1:
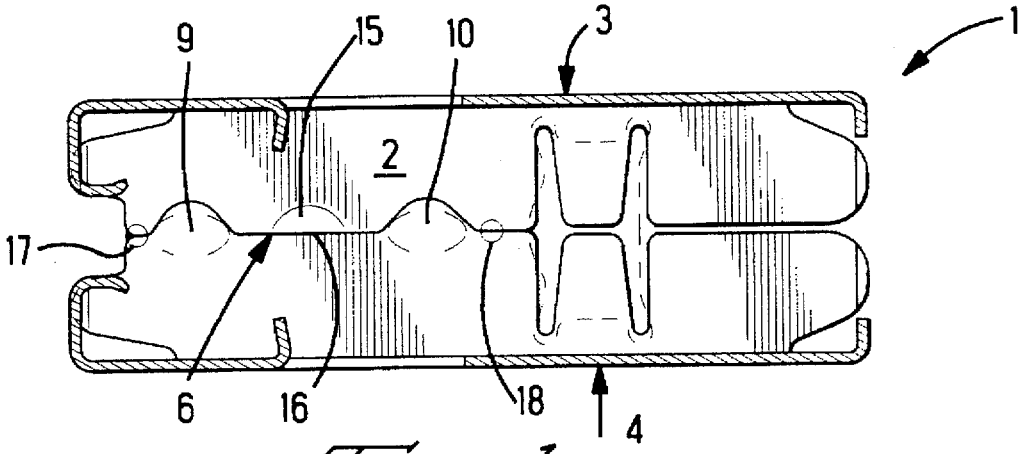
FIG. 1 shows a contact part, in section having the shape of a box according to the present invention.
Figure 2:
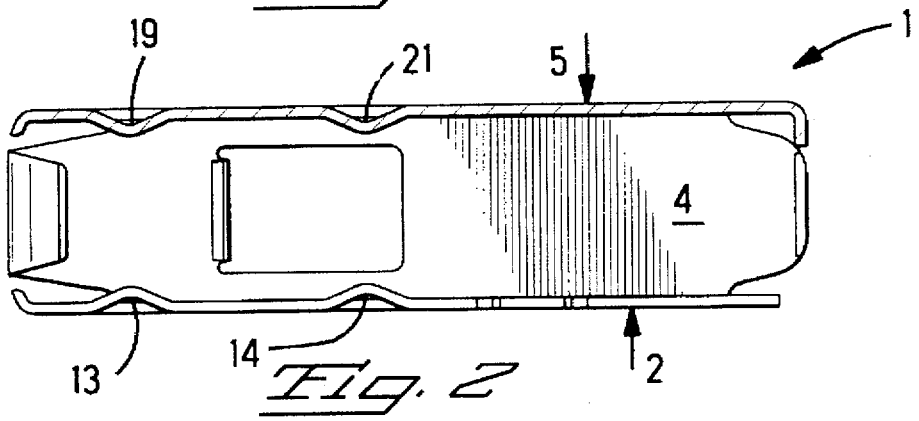
FIG. 2 shows a side sectional view of the contact part of FIG. 1 taken along the seam.
Figure 3:
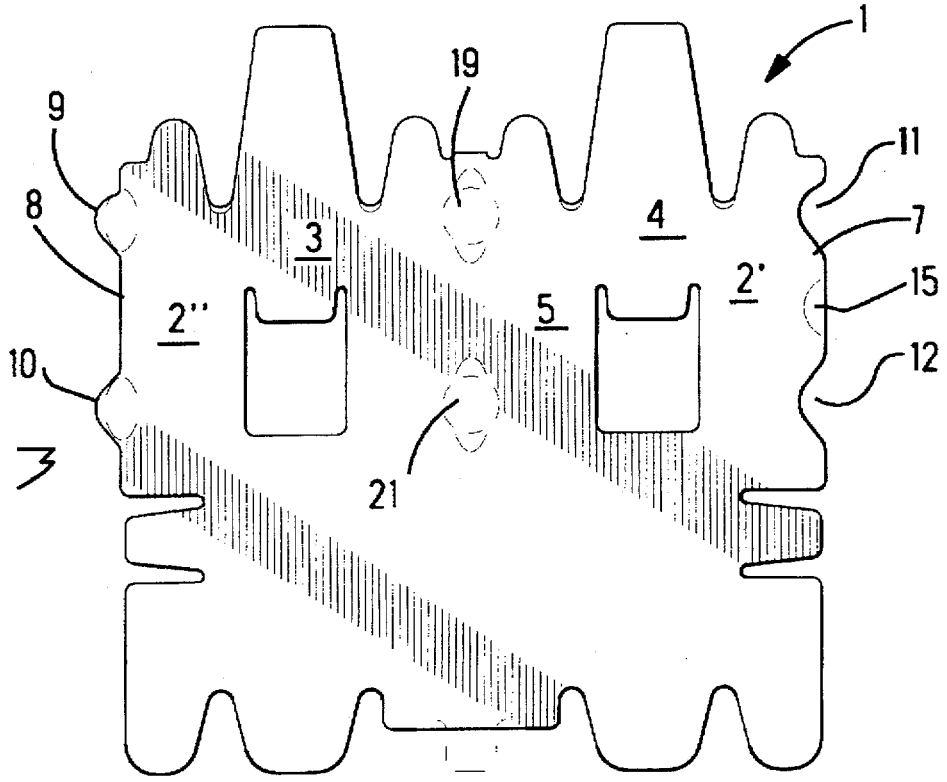
FIG. 3 shows a plan view of the contact part of FIG. 1.

A preferred embodiment of the present invention will now be described with reference to the drawings. The part according to the invention is mostly formed from a stamped sheet. Such a stamped part is illustrated in the FIGS. 1–3. The part 1 in the shape of a box is produced from this sheet by bending. Clearly to be seen are the three side walls 3, 5 and 4. The fourth side wall 2 is produced from the two partial walls 2' and 2" having the respective edges 7 and 8. It is to be seen that the edges 7 and 8 are partially of counterbalanced configuration. The edge 7 has recesses 11 and 12, while the edge 8 has projections 9 and 10. When the part 1 in the shape of a box is bent together, the projections 9 and 10 engage in the recesses 11 and 12. A seam 6 is formed between the two edges, as is to be seen in FIG. 1. Depressions 13, 14 in the shape of a spherical cap, which are particularly easy to discern in the section of FIG. 2, are located in the two projections 9 and 10. A further depression 15, in the shape of half a spherical cap, is embossed in the edge 7. This depression terminates with its cut surface 16 exactly on the edge. The depressions provided prevent the two partial walls of the wall 2 from being pushed over one another in the case of a lateral effect of force. An additional fixing of the two edges 7, 8 at the seam 6 can be provided by spot welds 17, 18.

Figure 4:
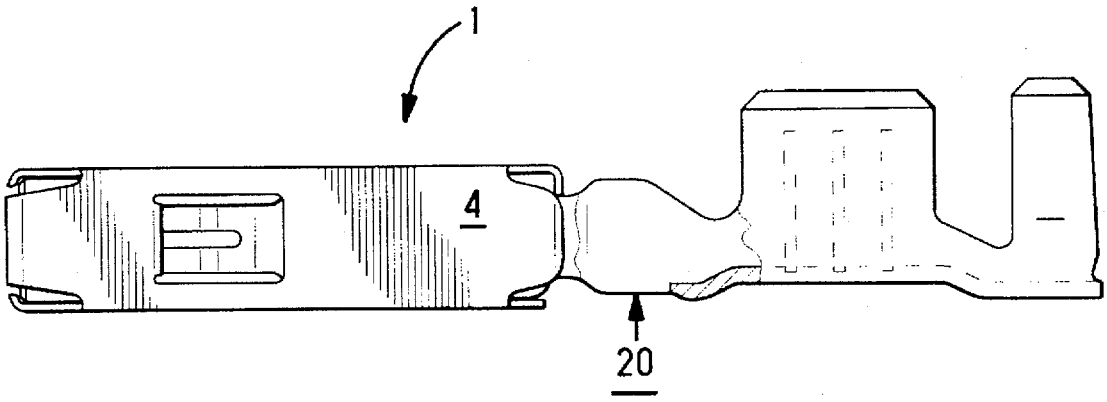
FIG. 4 shows a side view of an electric contact according to the present invention having an outer spring member and an inner contact member.
Figure 5:
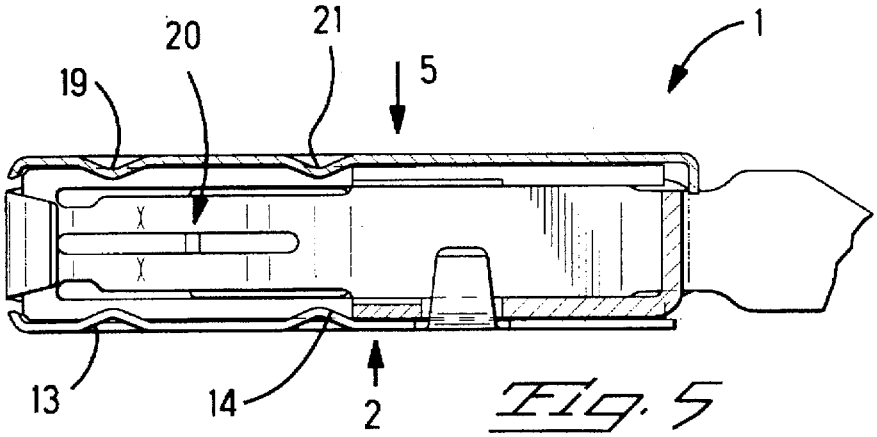
FIG. 5 shows a sectional view of the electric contact of FIG. 4.
Figure 6:
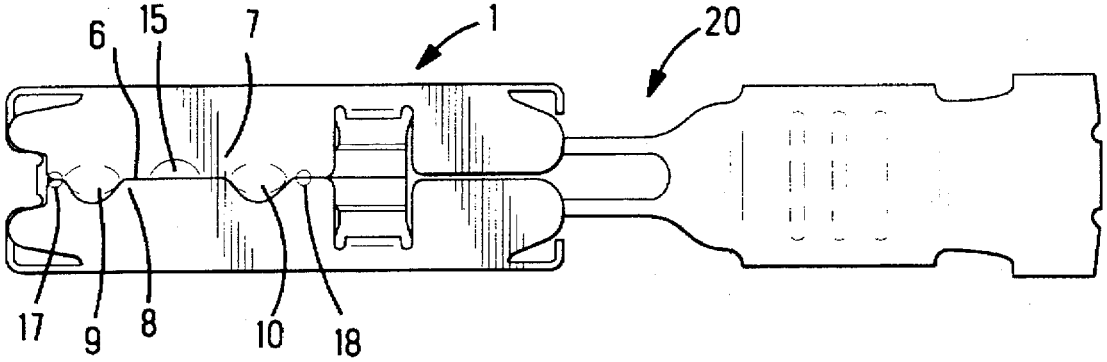
FIG. 6 shows a bottom view of the electric contact of FIG. 4.

The part described above can be part of an electric contact which has further means for fastening a cable or for receiving a contact pin. FIGS. 4 to 6 show an electric contact for a plug-and-socket connection having an inner contact member 20 and an outer spring member 1, the spring member being formed from a sheet, being constructed in the shape of a box and having at least four side walls 2 to 5. The inner contact member is inserted into an outer spring member 1, which corresponds to the part described in FIGS. 1 to 3. To facilitate the guidance of the inner contact member 20 which is to be inserted, depressions 19, 21 in the shape of a spherical cap are provided not only on the seam side of the outer spring member 1 but also on the opposite side 5.

A part of an electric contact which is constructed in the shape of a box and has the features according to the invention can not only be used together with an inner contact member, as described in FIGS. 4 to 6. It can also be a part of another electric contact which is not constructed from two mutually independent parts.

We claim:

1. An electric contact comprising a part that is formed from a sheet in the shape of a box with at least one side wall, a seam is formed in the one side wall by opposite edges, where the opposite edges of the sheet abut one another, the opposite abutting edges, being of counterbalanced configuration and at least one edge having a projection and the other edge having a corresponding recess in the form of a cutout, the projection being received in the recess, the opposite edges having at least one embossed area being displaced out of the side wall and abutting the opposite edge to prevent the opposite abutting edges from pushing over one another and the at least one embossed area being located in the projection.

2. The electric contact according to claim 1 wherein the embossed area is an elevation.

3. The electric contact according to claim 1 wherein the embossed area is a depression.

4. The electric contact according to claim 1 wherein the embossed area is configured in the shape of a spherical cap.

5. The electric contact according to claim 1 wherein the embossed area is configured in the shape of half a spherical cap.

6. The electric contact according to claim 1, wherein one edge has an elevation or depression in the shape of a half spherical cap with a cut surface, the cut surface of the elevation or depression in the shape of half a spherical cap coinciding with the edge.

7. An electric contact according to claim 1, wherein the edges are welded to one another at least in a pointwise fashion.

8. An electric contact for a plug-and-socket connection comprising an inner contact member and an outer spring member which is formed from a sheet, the outer spring member being constructed in the shape of a box, having at least four side walls and is assembled in such a way that there is located in one side wall a seam at which opposite edges of the sheet abut one another, the opposite abutting edges being of counterbalanced configuration and at least one edge having a projection and the other edge having a corresponding recess in the form of a cutout, the projection being received therein, and in that the opposite edges have at least one embossed elevation or at least one embossed depression being disposed out of the side wall in the projection and abutting the opposite edge; wherein the opposite abutting edges are prevented from pushing over one another.

9. Electric contact according to claim 8, wherein on the side with the seam and the opposite side, the outer spring member has depressions for the purpose of guiding the inner contact member.

* * * * *